United States Patent [19]

Verbickas et al.

[11] 4,248,073

[45] Feb. 3, 1981

[54] CLUSTER TYPE COLD ROLLING MILL

[75] Inventors: Robert C. Verbickas, Wolcott; John W. Turley, Oxford, both of Conn.

[73] Assignee: T. Sendzimir, Inc., Waterbury, Conn.

[21] Appl. No.: 6,804

[22] Filed: Jan. 26, 1979

Related U.S. Application Data

[63] Continuation-in-part of Ser. No. 880,601, Feb. 23, 1978, abandoned.

[51] Int. Cl.[2] ..... B21B 13/14; B21B 29/00; B21B 31/16

[52] U.S. Cl. ..... 72/243

[58] Field of Search ..... 72/242, 243, 241, 238, 72/237, 244

[56] References Cited

U.S. PATENT DOCUMENTS

| | | | |
|---|---|---|---|
| 2,907,235 | 10/1959 | Murahami | 72/243 |
| 3,128,650 | 4/1964 | Leufren | 72/242 |
| 3,373,590 | 3/1968 | Knappe | 72/243 |
| 3,815,401 | 6/1974 | Sendzimir et al. | 72/242 |

*Primary Examiner*—Milton S. Mehr
*Attorney, Agent, or Firm*—Frost & Jacobs

[57] ABSTRACT

A cluster type rolling mill intended to provide work roll sizes in the range between the small sizes available with current cluster mill designs and the large sizes available with current four-high mill designs is disclosed.

This mill combines the advantages of existing cluster mills (heavier reductions per pass and between anneals) with the advantages of four-high mills (easier to maintain thermal equilibrium of work roll giving ability to roll at higher speeds).

6 Claims, 15 Drawing Figures

CLUSTER TYPE COLD ROLLING MILL

CROSS-REFERENCE TO RELATED APPLICATION

This application is a continuation in part of an application filed Feb. 23, 1978, Ser. No. 880,601, in the names of Verbickas and Turley, abandoned.

BACKGROUND OF THE INVENTION

The object of this invention is to provide improvements in the construction of cold metal rolling mills, with the purposes of improving their production capability, and improving the flatness of the rolled product.

The earliest known form of rolling mill is the two high mill. This type of mill is still used successfully in some areas, notably where the material to be rolled is relatively soft, as in hot rolling. When harder materials are to be rolled, such as cold metals, the two high mill has become virtually obsolete, since it is not possible to design a two high mill having roll neck bearings of sufficient strength to withstand the roll separating forces in cold rolling.

For this reason the four high mill was developed. In this case relatively small work rolls are used to minimize the roll separating force, and large back-up rolls mounted in large bearings are used to support the work rolls. In order to minimize the work roll diameter (and so to maximize the reducing capability of the mill) the back-up rolls are sometimes driven, and the work rolls non driven. Even so, there is always a practical upper limit to the length to diameter ratio of the work roll, since the work roll is only fully supported in a vertical plane through its axis, and in the horizontal plane through said axis it is only supported at the ends.

The cluster mill (Rohn-U.S. Pat. No. 2,085,449, Sendzimir-U.S. Pat. Nos. 2,169.711; 2,187,250 and 2,776,586) was originally conceived to overcome the limitations of the four high mill, by providing full support of the work rolls in both vertical and horizontal planes throughout their length. The Sendzimir version of the cluster mill also provided virtually uniform support of intermediate rolls by means of casters (eliminating backing roll deflection as a source of flatness error). Several hundred Sendzimir mills have been installed around the world, since for rolling of tough materials such as stainless and alloy steels, high carbon steels, nickel and cobalt alloys and such, the small work roll diameter is necessary.

However, for many materials, particularly for the more common metals such as low carbon steel, copper, brasses, bronzes and aluminum and its alloys, the small work roll of the Sendzimir mill is not necessary for economical operation. Moreover, the small work roll can actually impose a limit on production, due to the greater difficulty of maintaining thermal equilibrium of a small work roll at high speeds then would be the case with a large work roll. On the other hand, the large work roll of the four high mill becomes very inefficient at light gauges due to flattening of said work roll against the surface of the rolled product.

Unfortunately, there is a practical lower limit to the length to diameter ratio of Sendzimir mill work rolls. If the work rolls become substantially larger than the intermediate rolls, spalling and even fracture of said intermediate rolls can result, and if the geometry is modified to use larger intermediate rolls, then the cluster can become unstable.

In practice, for a 72 inch wide rolling mill, the Sendzimir mill has a maximum work roll diameter of about 4 inches. A four high mill, on the other hand of the same 72 inch width, would have a minimum work roll diameter of about 20 inches. For narrower mills, the equivalent diameters of both Sendzimir and four high mill work rolls would be proportionately lower.

Clearly a rolling mill configuration which could be used for work roll sizes in the range 4–20 inches (for a 72" wide mill-proportionately smaller for narrower mills) would potentially be capable of combining the advantages of both 20-Hi cluster mills and four high mills. If such a mill design were available, it would then be possible to establish theoretically the optimum work roll diameter for a given material and thickness range, and then select the mill configuation which would provide this diameter. This would be a big improvement on the present state of the art, where it is usually necessary to choose a work roll diameter either larger or smaller than the optimum, depending on the limitations of the chosen roll configuration.

The present invention discloses a new cluster mill arrangement which can incorporate work roll sizes in the range between existing cluster mill roll sizes and four high mill roll sizes. This arrangement shares the basic characteristic of all Sendzimir cluster mills in that all rolls in the cluster are supported in both horizontal and vertical planes throughout their length.

The present invention also discloses how the optimum work roll diameter for a given material is established, and how this diameter can be achieved using a mill according to the present invention, which thereby represents an improvement on prior art mills for which this optimization cannot, in general be achieved.

Figure 1:
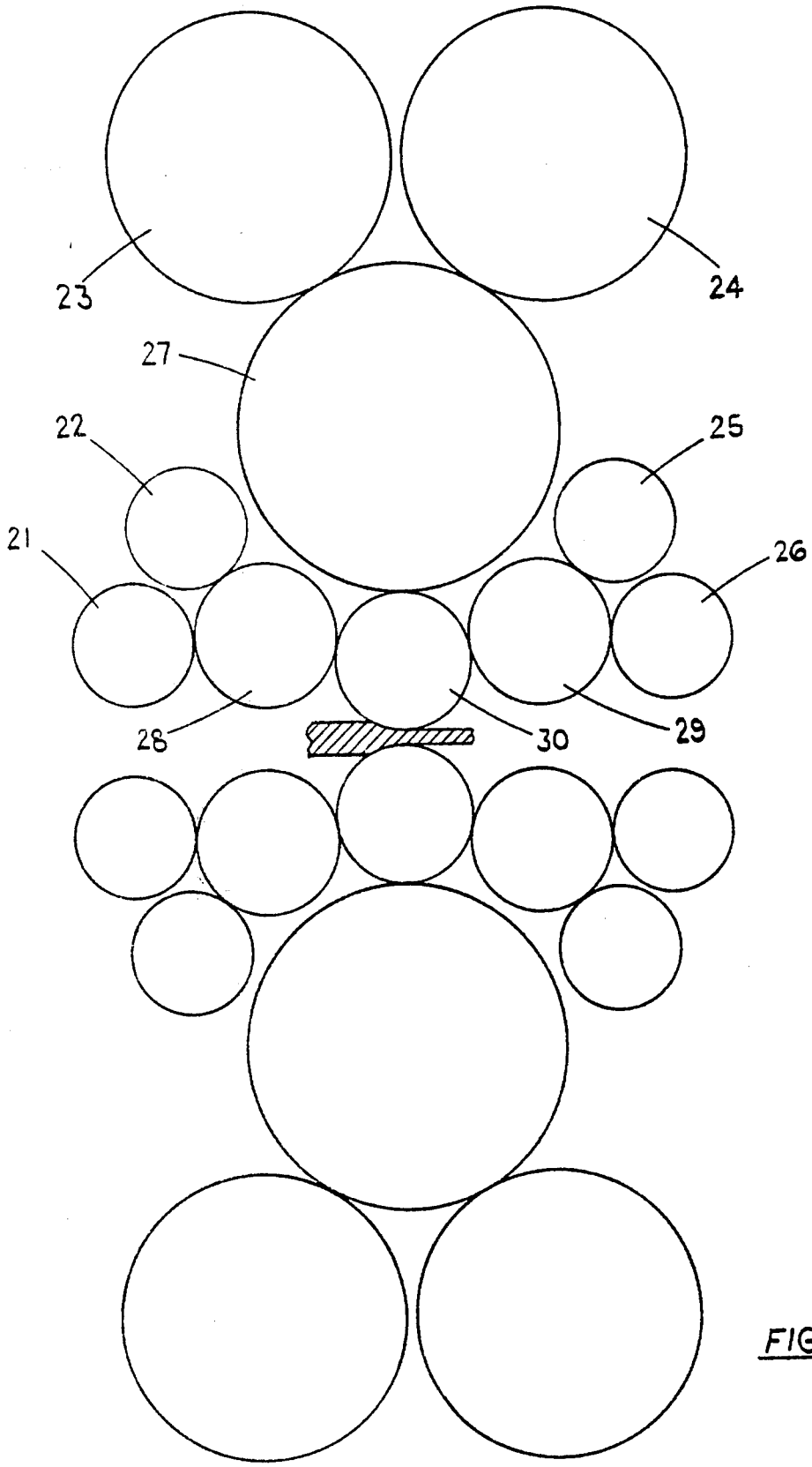
FIG. 1 shows in diagrammatic form the geometry of the roll cluster according to the present invention.

The subject of the present invention is shown in diagrammatic form in FIG. 1. It can be described as a 20-High geometry having a 1-3-6 configuration (1 work roll, three intermediate rolls and six backing rollers in each of the two clusters.)

In the upper cluster, work roll 30 is supported by three intermediate rolls 27, 28 and 29. Side intermediate roll 28 is supported by backing rollers 21 and 22, side intermediate roll 29 is supported by backing rollers 25 and 26, and central intermediate roll 27 is supported by backing rollers 23 and 24. Construction of the lower cluster is identical.

The construction of backing rollers and support assemblies would be according to the prior art-each assembly would consist of a stationary shaft supported by fixed saddles at intervals along its length, rollers (casters) being rotatably mounted upon said shaft, said rollers being in direct contact with, and directly supporting an intermediate roll in the cluster, and said saddles being directly supported by the mill housing.

It will be noted that the side backing rollers 21, 22, 25 and 26 are smaller in size than upper backing rollers 23 and 24. This is because rollers 23 and 24 will, in general, support the highest load.

One characteristic of this cluster is that it is statically indeterminate-the amount of support of the work roll provided by the side intermediate rolls 28 and 29 will depend on relative stiffnesses of the cluster and supporting elements. A disadvantage of this feature is that it is necessary to adjust the positions of backing rollers 21 and 22, and 25 and 26 in order to take out any clearance between the side intermediate rolls 28 and 29 and work roll 30 (which might arise, for example, if said work roll 30 is changed to one of a smaller size). This adjustment is not necessary with clusters according to the prior art which are statically determinate.

Figure 2:
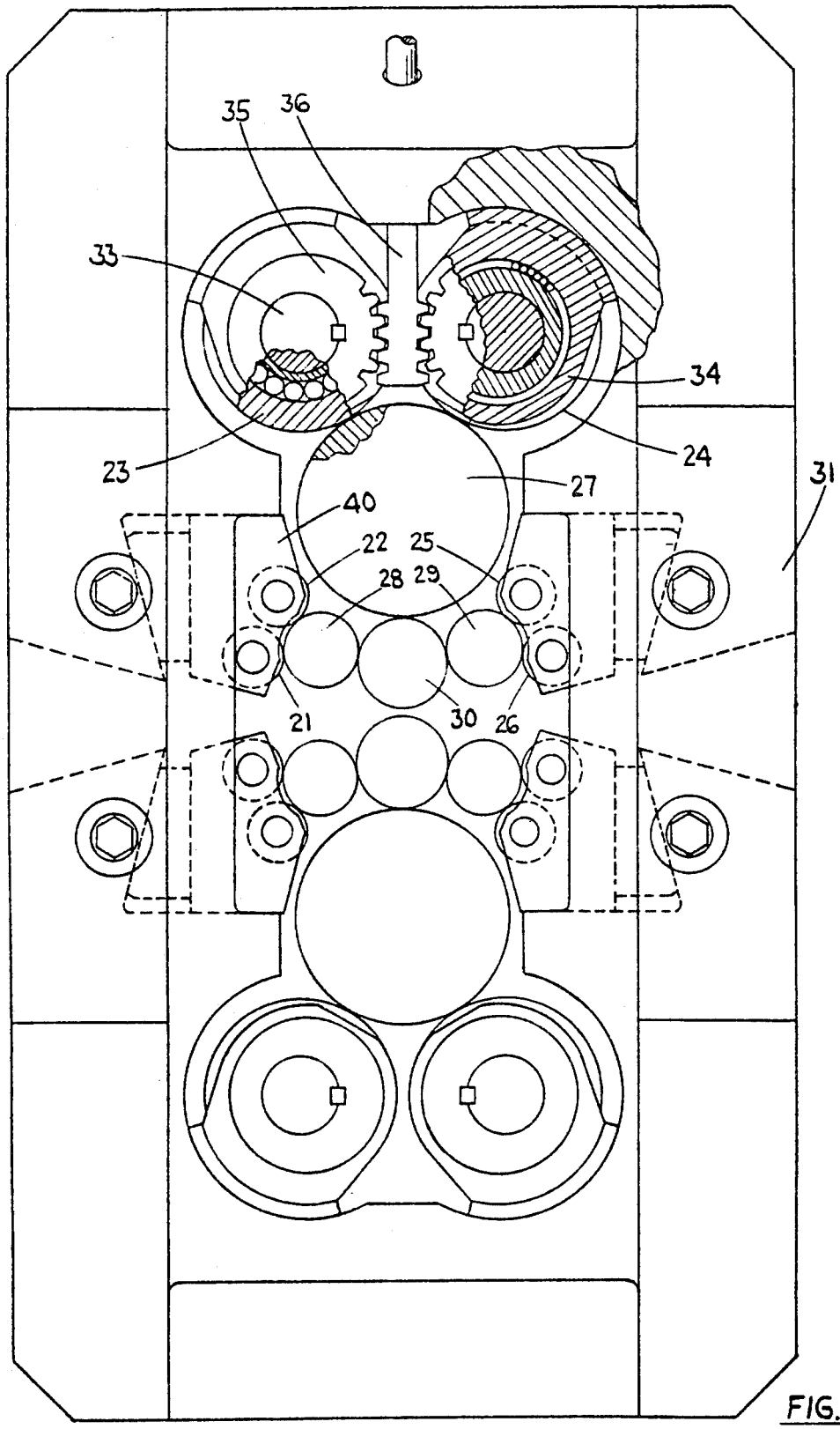
FIG. 2 is a partially sectioned front elevational view showing said roll cluster mounted in a one piece housing.
Figure 3:
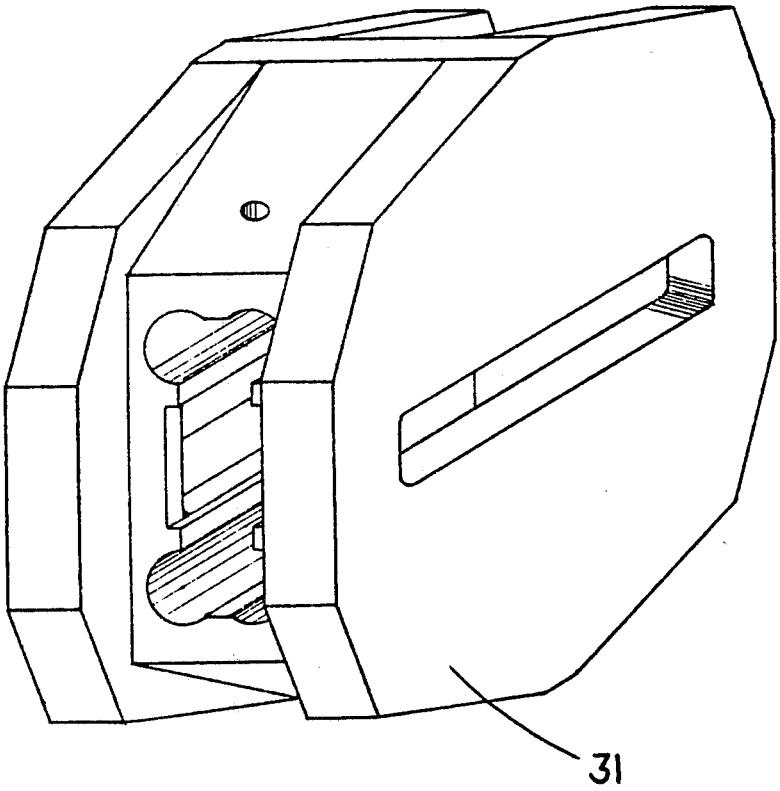
FIG. 3 is an isometric view of said one piece housing.

One embodiment of the invention is shown in FIG. 2. In this case the cluster has been mounted in a one piece housing 31 of the type used on existing Sendzimir cluster mills. (The construction of this housing is shown in FIG. 3).

The upper and lower sets of backing rollers 23 and 24 are considerably larger than the side backing rollers 21, 22, 25, and 26. Said upper and lower backing rollers and support assemblies are identical to those in the prior art and (see FIG. 2 and FIG. 4) consist of rollers 23, 24 mounted on shafts 33 which are supported in the housing bores by saddles 34. Shafts 33 are eccentrically mounted within said saddles and screwdown is accomplished by rotating said shafts by means of gear 35 and rack 36.

Figure 4:
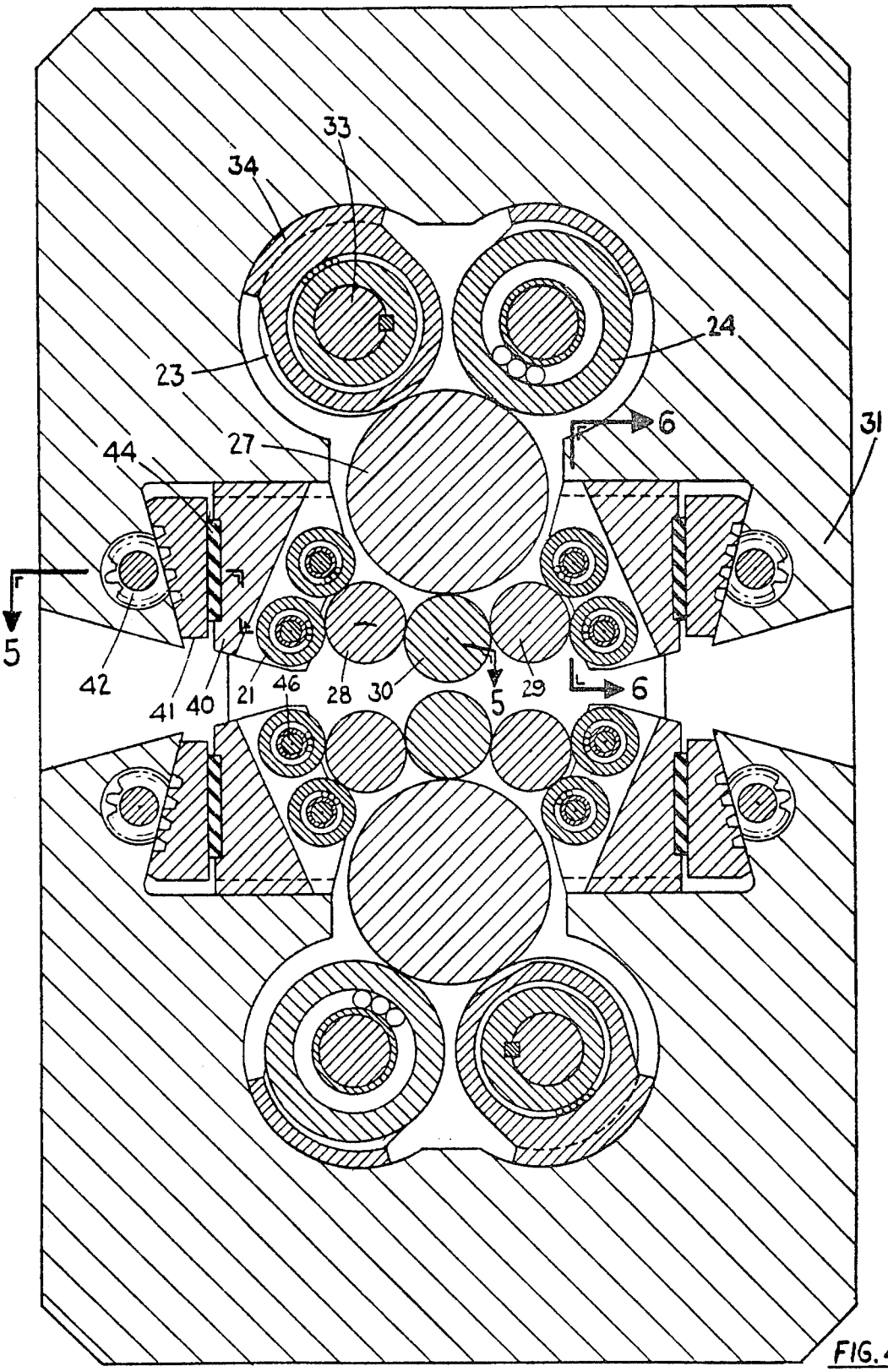
FIG. 4 is a sectional elevational view showing said roll cluster mounted in said one piece housing.
Figure 5:
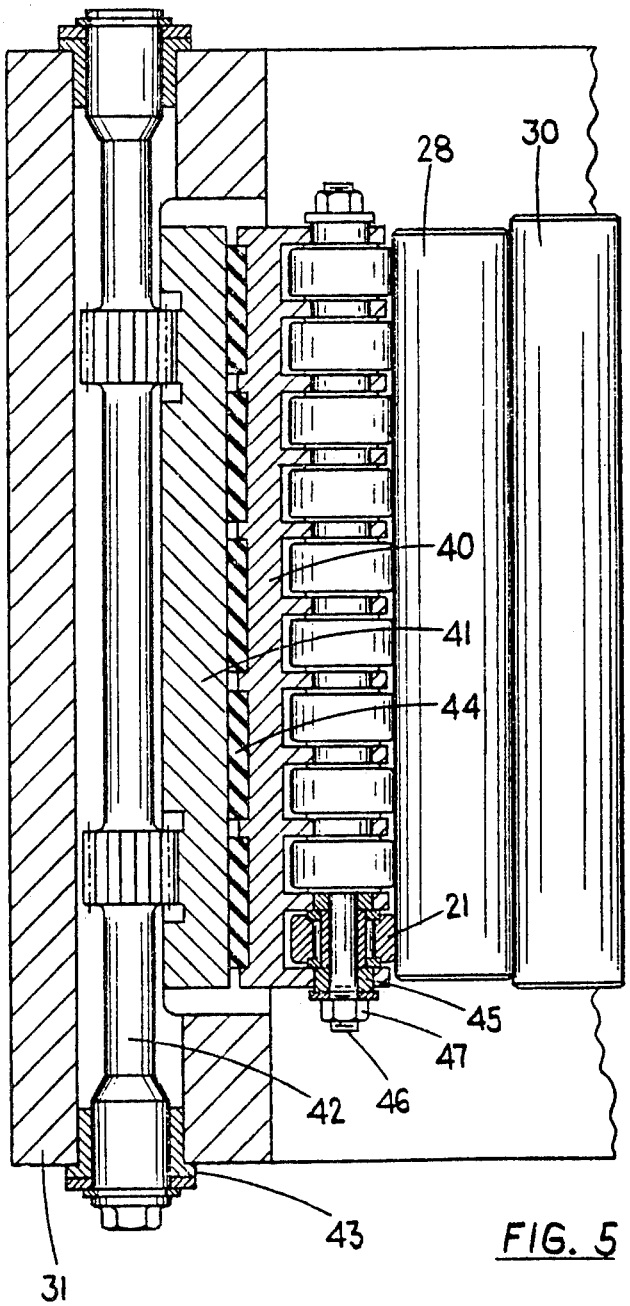
FIG. 5 is a transverse sectional view taken along line 5—5 of FIG. 4 showing construction and adjustment of side backing assemblies.
Figure 6:
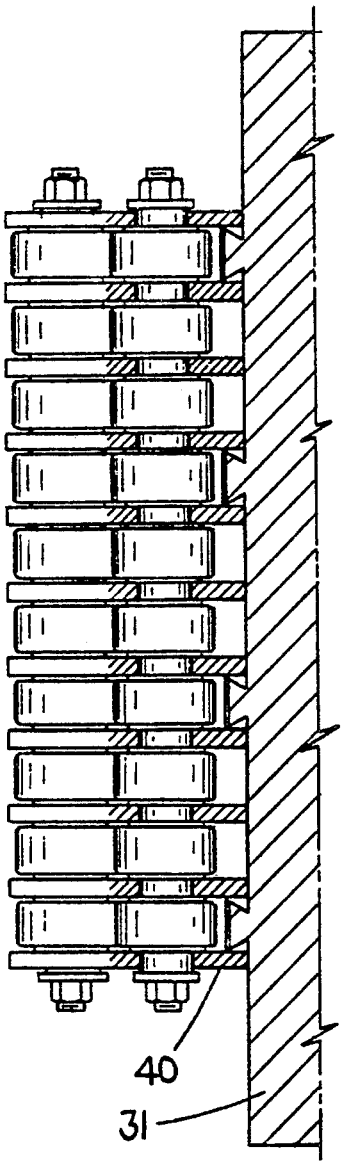
FIG. 6 is a sectional elevational view taken along line 6—6 of FIG. 4 showing construction and adjustment of side backing assemblies.

As shown in FIG. 4 and FIG. 5 a typical side set of backing rollers 21 is mounted on shaft 46. Said rollers are mounted within recesses in support beam 40 to which they are rotatably mounted by means of shaft 46. Spacer sleeves 45 are used to locate said rollers centrally within the recesses in said support beam and the inner races of rollers 21 are clamped by nuts 47. Said support beam is supported horizontally by wedge 41 via pad 44 and vertically by dovetail connection to housing 31, as shown in FIG. 6. Pads 44 may be of a resilient material allowing some horizontal movement of rolls 28 and 29 as work roll 30 moves up and down during screwdown movements. Said wedge is supported horizontally by the mill housing 31. Clearance between the intermediate rolls 28 and 29 and work roll 30 is taken out by laterally moving said support beam by adjustment of said wedge. Said wedge adjustment is accomplished by rotating pinion shaft 42 whose gear teeth mesh with corresponding rack teeth in said wedge. Raising the wedge along the inclined surface on the mill housing will cause said support beam and rollers 21 and 22 to move laterally. Pinion shaft 42 is rotatably supported in the mill housing on bushings 43.

The construction of all four side sets of backing assemblies and their support and adjustment mechanisms are similar and are as described above.

Figure 7:
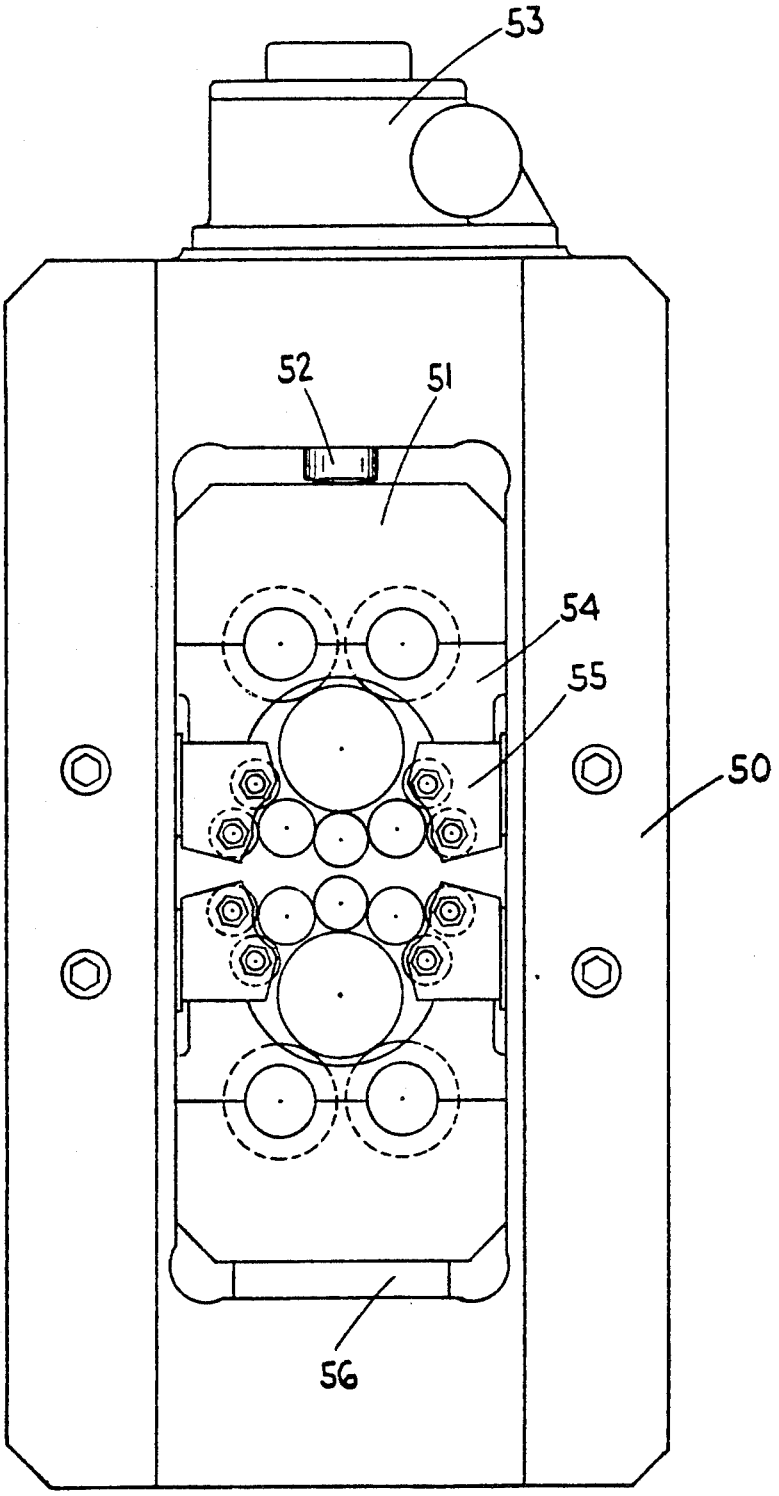
FIG. 7 is a front elevational view of another embodiment showing said roll cluster mounted using a conventional clock and screwdown arrangement within a housing.

FIG. 7 shows a second embodiment of the invention. In this case the cluster has been mounted within a housing 50. Said housing is provided with spacers 56 at the bottom of the housing window and screws 52 at the top of the housing window. Said screws can be driven through gear reducers 53 in order to adjust the roll gap according to the prior art.

Figure 8:
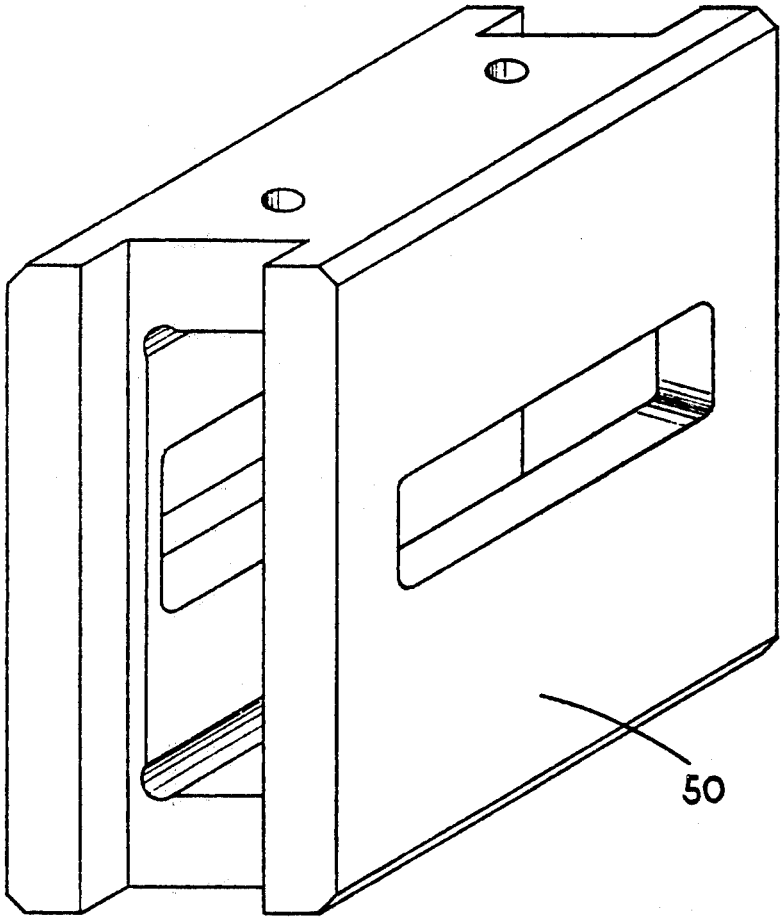
FIG. 8 is an isometric view of housing of FIG. 7.

FIG. 8 shows typical construction of housing 50. Said housing could either be cast in one piece, or fabricated from two conventional 4-high mill housings, with bolted or welded spacers linking the two.

Figure 9:
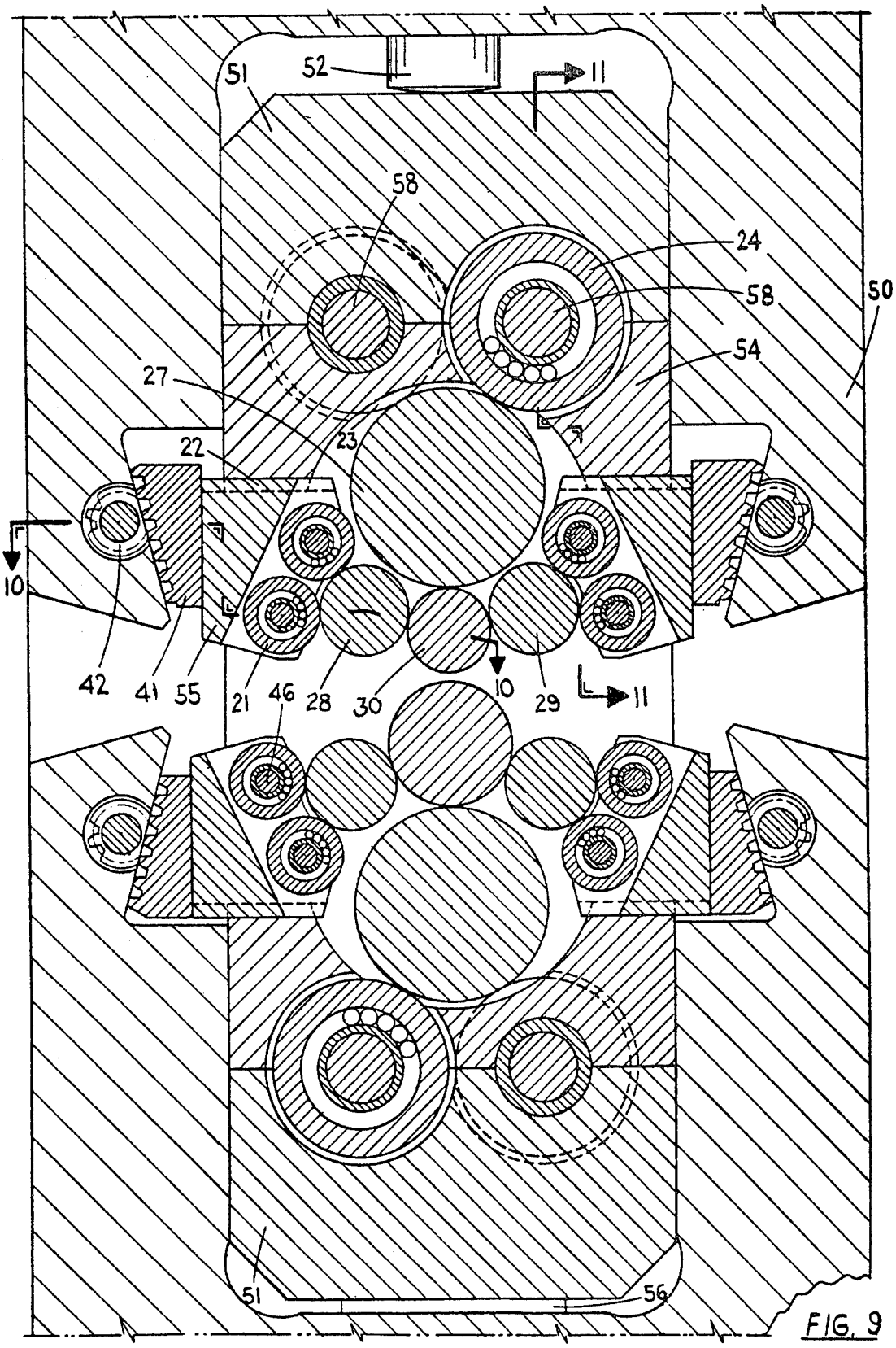
FIG. 9 is a sectional elevational view of said roll cluster mounted as in FIG. 7, and showing adjustment to give larger work rolls.
Figure 11:
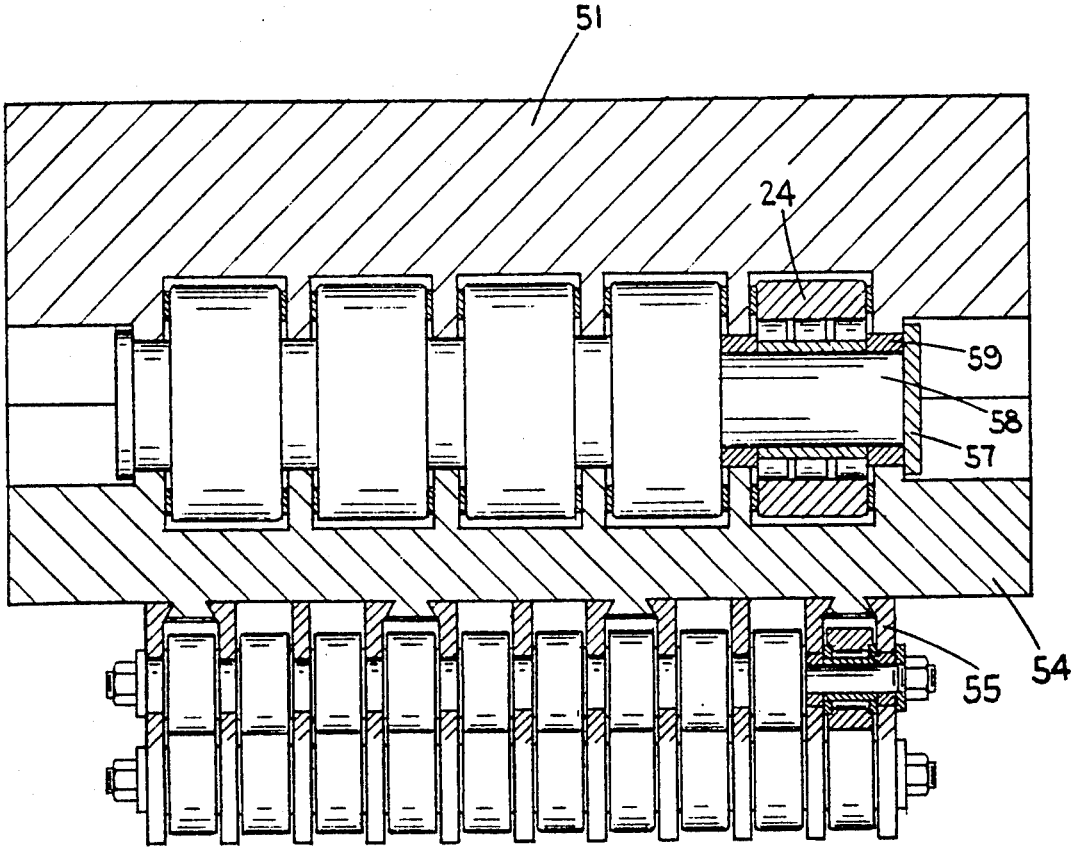
FIG. 11 is a sectional elevational view taken along line 11—11 of FIG. 9 showing construction of side and upper backing assemblies.

As shown in FIG. 9 and 11, the upper and lower backing assemblies consist of rollers 23 and 24 mounted on shafts 58. In this case shafts 58 are supported by support beams 51. Said shafts are clamped to said support beams by means of caps 54 which are bolted to said support beams. Rollers 24 are spaced on shaft 58 by spacers 59 and clamped axially by retainer plates 57 which are bolted on each end of said shafts. Caps 54 are provided with dovetails which engage with matching dovetail grooves on side support beams 55, giving them support in the vertical plane. The lower support beam rests upon spacers 56 and the upper support beam is preloaded against screws 52 by means of counterbalance cylinders according to the prior art.

Figure 10:
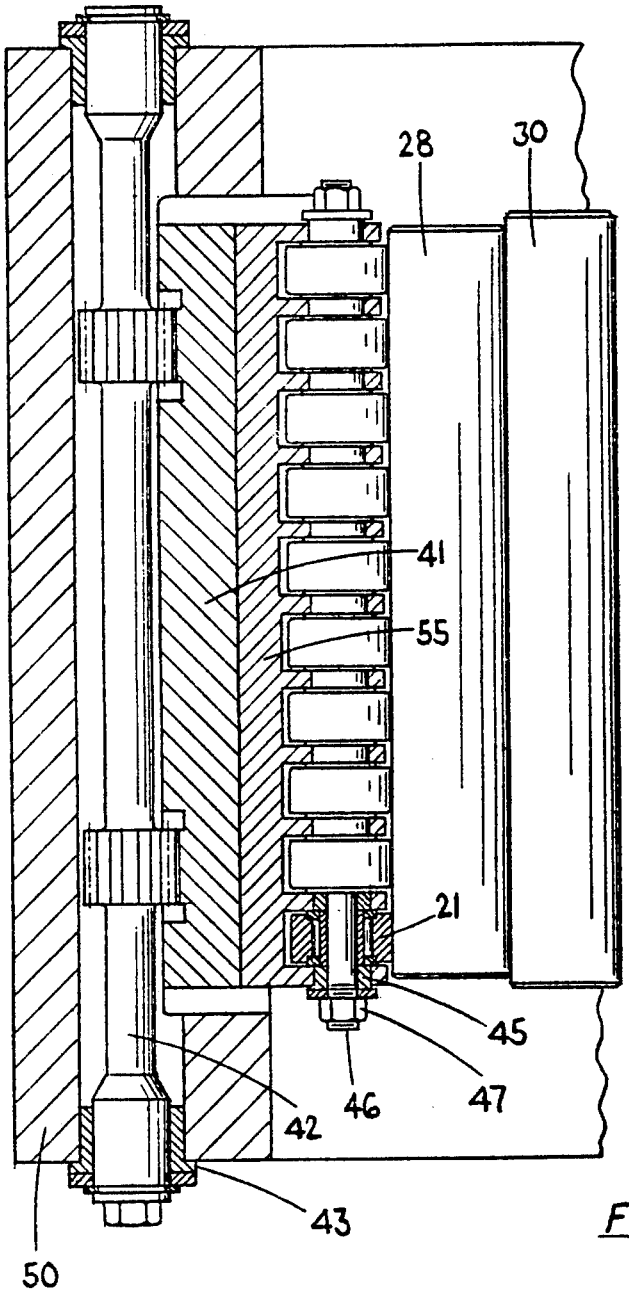
FIG. 10 is a transverse sectional view taken along line 10—10 of FIG. 9 showing construction and adjustment of side backing assemblies.

The arrangement and method of adjustment of side backing rollers and side support beams is as described above and as shown in FIGS. 4 and 5. However, as shown in FIG. 9, 10 and 11 the support beams 55 are not supported in the vertical plane by the housings, but are supported by caps 54. Thus, as the screwdown is operated, the side backing rollers 21 and 22 are raised and lowered with the work roll 30. In this case there is no need for resilient pads between side support beams and adjusting wedges 41, so side support beams 55 rest directly against said adjusting wedges.

FIG. 9 also shows how a larger work roll can be accommodated in the lower cluster by operating the adjusting wedges 41 to retract the side backing assemblies and using a thinner spacer 56 to provide the necessary extra vertical space. In a similar manner a larger work roll can be used for the upper cluster also.

Figure 12:
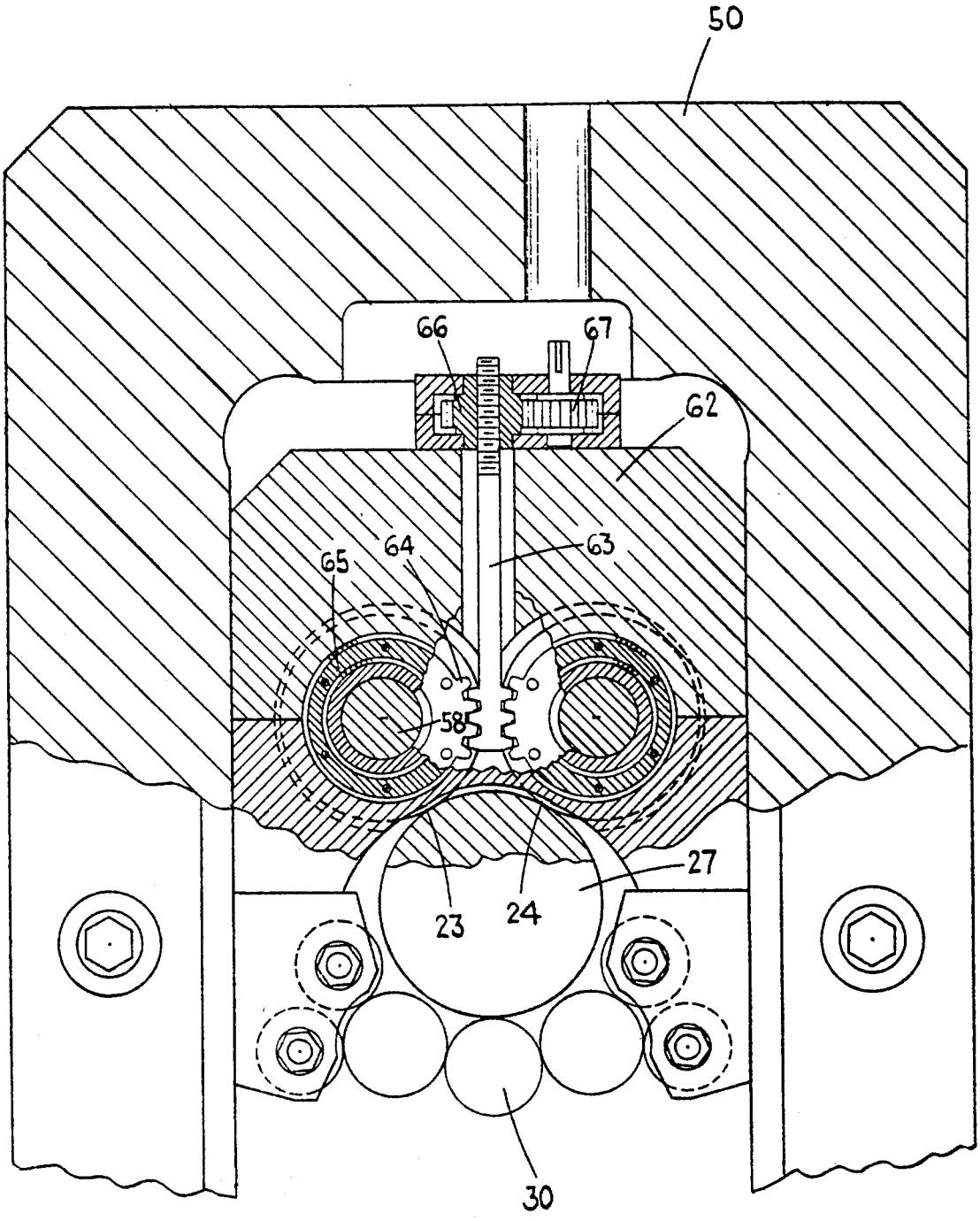
FIG. 12 is a partially sectioned front elevational view of said roll cluster mounted as in FIG. 7 showing incorporation of crown adjustment means.

FIG. 12 shows how a crown adjustment drive, according to the prior art, can be incorporated into the arrangement of FIG. 9. Shafts 58 can be bent to the desired profile by rotating eccentrics 65 by means of gears 64 (riveted to said eccentrics) and racks 63. Eccentrics 65 are mounted between each roller 23 and its neighbor on the same shaft. Each rack 63 is raised and lowered by means of jack nut 66 which has an internal screw thread engaging with a male thread on said rack. Said jack nut also has an external gear which meshes with gear 67. A drive mounted on top of housing 50 is used to effect rotation of gear 67.

Figure 13:
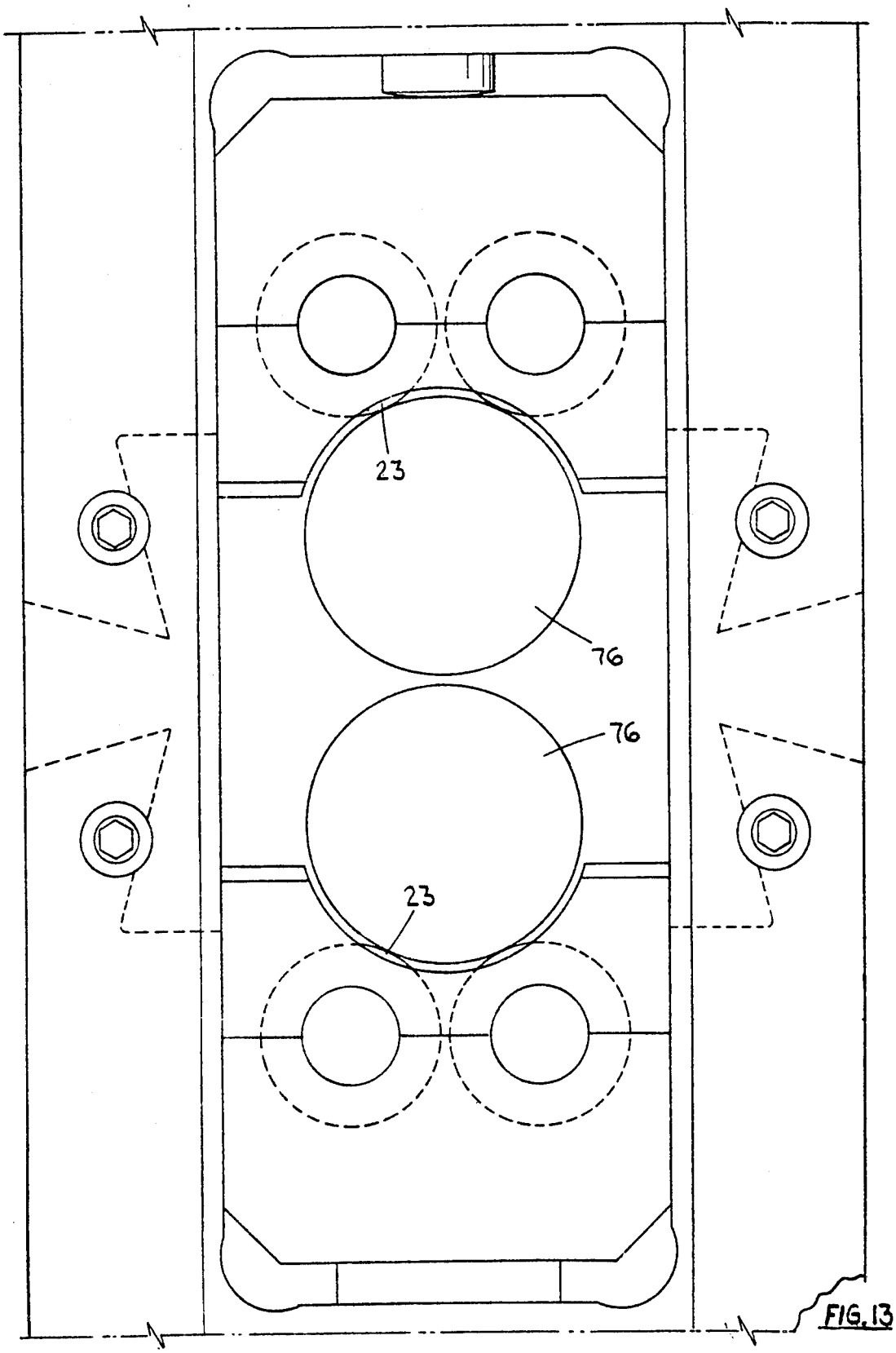
FIG. 13 is a diagrammatic front elevational view showing conversion to give a conventional 1-2 cluster configuration.

By removing all intermediate rolls, work rolls, side backing assemblies and side support beam assemblies and replacing these with two large work rolls a mill according to the present invention can be converted to a conventional 6-high cluster mill (1-2 configuration) suitable for temper or skinpass rolling. This arrangement is shown in FIG. 13.

It is envisaged that other features of design will be according to the prior art. Drive may be direct to the work rolls or indirectly via upper and lower intermediate rolls 27, the latter being preferable when relatively small work rolls are used. Axial adjustment of intermediate rolls 27 may also be provided according to prior art, enabling control of strip edge profile to be obtained.

In the embodiments shown on the accompanying drawings, screw and wedge type adjustment of the side backing roller assemblies is incorporated. Alternatively the adjustment may be by other mechanical means or by hydraulic means or by combination of mechanical and hydraulic means.

It is well known that the maximum reduction that can be achieved in one pass during cold rolling is a direct function of work roll diameter. The maximum reduction can be a limiting factor during roughing. In this case, if front and back tensions are equal, to ensure that the rolls will bite, and skidding will not occur, the condition $\delta_{max.} \leqq 2\mu^2 D_2$ (i) must be satisfied, where $\delta_{max.} = (H1 - H2)_{max.}$ = maximum reduction that can be achieved (inch).

Another well known relationship which applies fairly accurately when roughing (where roll flattening can usually be ignored) is $$RSF = K\sqrt{\frac{D2\delta}{2}} \quad \text{(ii)}$$

where RSF is the specific roll separating force (lb/inch of width)

$\delta$ is the reduction (inch)

$\mu$ = roll bite friction coefficient $D_2$ = work roll diameter (inch)

H1 = entry gauge, H2 = exit gauge (inch)

Roughing is normally carried out, whether on tandem mills or on reversing mills, at strip speeds of about 800 FPM or less. At this speed, Stone gives, for various lubricants, roll bite friction coefficient values of about 0.07, and this agrees with our own experience. Using this value, relationship (i) reduces to $\delta_{max.} \simeq$ D2/100 under limiting conditions (iii) Substituting this value in (ii) gives $$RSF = KD2/14.14 \text{ lb/in.} \quad \text{(iv)}$$

At the same time, the power required to achieve this reduction (at a reference speed of 100 FPM) is given by $$\text{power } V = \frac{\delta \times K \times 100}{33{,}000} = \frac{D2 \times K}{33{,}000} \text{ HP/100FPM/in} \quad \text{(v)}$$

Also, the ratio RSF/power at 100 FPM is given by $$\frac{RSF}{V} = \frac{KD2}{14.14} \times \frac{33{,}000}{KD2} = 2333 \text{ lb/HP per 100FPM} \quad \text{(vi)}$$

Note that this ratio is independent of the hardness K of the material to be rolled.

Using the above relationships we can conclude that, for a given roll separating force and material hardness, there is an optimum work roll diameter which will give the highest possible reduction during roughing rolling. A larger work roll will not be able to achieve such a high reduction because the same separating force will develop at a lower reduction. (as governed by equation (ii)). A smaller work roll will not be able to achieve such a high reduction because skidding will start to occur at a lower reduction (as governed by equation (iii)).

We will show that, for a very wide range of materials the values of work roll diameter obtainable using prior art rolling mill designs are either much bigger or much smaller than the optimum diameter, whereas with the rolling mill of subject invention, an optimum work roll diameter can be obtained.

In the case of four-high mills, certain proportions have been found to be necessary. In general, the maximum backup roll diameter is made equal to the width of the strip to be rolled, and the minimum work roll diameter can be no less than about one-third of the strip width (limited by roll neck stresses).

Furthermore, based upon a study of available commercial roller bearings for rolling mill back-up rolls, we can say $$RSF = 1500 \text{ D1} \quad \text{(vii)}$$

where D1 is the back-up roll diameter. Equations (vii) and (iv) can be used to construct the following table for four-high mills.

TABLE 1

| | | | | | | |
|---|---|---|---|---|---|---|
| Strip Width in | 72 | 60 | 48 | 36 | 24 | 18 |
| D1 in | 72 | 60 | 48 | 36 | 24 | 18 |
| actual D2 in | 24 | 20 | 16 | 12 | 8 | 6 |
| Max. RSF × 1000 lb/in For max. reduction (A) | 108 | 90 | 72 | 54 | 36 | 27 |
| D2 above, K = (1000lb/in²) (K = 14.14 × RSF/D2) (B) | 64 | → | → | → | → | → |
| K = 150,000, D2 = (in) (C) | 10.2 | 8.5 | 6.8 | 5.1 | 3.4 | 2.6 |
| K = 100,000, D2 = (in) (D) | 15.3 | 12.7 | 10.2 | 7.6 | 5.1 | 3.8 |
| K = 50,000, D2 = (in) (D2 = 14.14 × RSF/K) | 30.5 | 25.5 | 20.4 | 15.3 | 10.2 | 7.6 |

It can be seen that, to achieve the maximum reduction at the rated RSF, a much smaller work roll diameter should be used for the tougher materials. Further, the actual minimum diameter D2 is much larger than the optimum value for materials with a resistance to deformation higher than 64,000 lb/in².

Clearly then, the four high mill only gives maximum possible reductions with strip having a resistance to deformation of 64,000 lb/in² or less. Only such materials as pure copper, aluminum and some aluminum alloys have resistance to deformation in this range, particularly after some work hardening has taken place.

In the case of 20-high cluster mills, proportions are dictated by geometry and must be within the range tabulated below:

TABLE 2

| | | | | | | |
|---|---|---|---|---|---|---|
| Mill size | 20 | 21 | 22 | 23 | 33 | 24 |
| Back-up bearing dia. in D0 | 20 | 16 | 11.811 | 8.858 | 6.299 | 4.724 |
| Drive roll dia. in D1 | 11.56 | 9.25 | 6.83 | 5.12 | 3.64 | 2.73 |
| Max RSF × 1000lb/in | 56.7 | 45.3 | 33.5 | 25.1 | 17.8 | 13.4 |
| Max HP/100 FPM ($15D1^2$) | 2004 | 1284 | 700 | 394 | 200 | 112 |
| Max HP/100 FPM/in (equn. (vi)) | 24.3 | 19.4 | 14.4 | 10.8 | 7.6 | 5.7 |
| Max width at max torque/in (= HP/100FPM ÷ HP/100FPM/in) | 90 | 72 | 51 | 37.5 | 27 | 21 |
| Saddle pitch in | 11.25 | 9 | 8.5 | 6.25 | 4.5 | 3.5 |
| Min width (3 saddle pitches) | 33.75 | 27 | 25.5 | 18.75 | 13.5 | 10.5 |
| Max work roll dia. $D_2$in. | 5.08 | 4.06 | 3.0 | 2.25 | 1.60 | 1.20 |
| Min work roll dia. $D_2$in. | 3.5 | 2.85 | 2.10 | 1.58 | 1.12 | .84 |
| For max. reduction | | | | | | |
| (A) $D_2$ max above K = (1000lb/in$^2$) | 158 | → | → | → | → | → |
| (B) D2 min. above, K = (1000lb/in$^2$) (K = 14.14 × RSF/D2) | 225 | → | → | → | → | → |
| (C) K = 150,000, D2 = (in) | 5.34 | 4.27 | 3.16 | 2.37 | 1.68 | 1.26 |
| (D) K = 100,000 D2 = (in) | 8.02 | 6.41 | 4.74 | 3.55 | 2.52 | 1.89 |
| (E) K = 50,000, D2 = (in) (D2 = 14.14 × RSF/K) | 16.03 | 12.81 | 9.47 | 7.10 | 5.04 | 3.79 |

It can be seen that, to achieve the maximum reduction at the rated RSF, a larger work roll should be used for the softer materials. Further, the actual maximum diameter D2 is larger than the optimum value for materials with a resistance to deformation lower than 158,000 lb/in.$^2$.

Clearly then, the 20-high cluster mill only gives maximum possible reductions with strip having a resistance to deformation in the range 158,000–225,000 lb/in$^2$. Only such materials as stainless steels, tool steels, high carbon steels and some exotic alloys have resistance to deformation in this range during the roughing passes.

Since the vast majority of cold rolling mills in the world are either four-high mills or 20-high cluster mills, and a very high percentage of the materials rolled have resistance to deformation in the range 64,000–158,000 lb/in$^2$, for which neither of said mills can provide a work roll size to give maximum possible reduction, it follows that the mill of subject invention which can provide work roll sizes optimized for materials having resistance to deformation in said range provides a significant step forward in the art.

It is proposed that the mill of subject invention should in general, use standard backing assemblies, and drive rolls as used on 20-Hi cluster mills (the central intermediate roll will be driven). For a given drive roll size the torque rating of subject mill (HP/100 FPM) will be half that of the 20-Hi mill since there are only two drive rolls, whereas the latter has four.

Basic data is tabulated below.

TABLE 3

| | | | | | | |
|---|---|---|---|---|---|---|
| Mill size | 40 | 41 | 42 | 43 | 44 | 45 |
| Back-up bearing dia. DO in | 20 | 16 | 11.811 | 8.858 | 6.299 | 4.724 |
| Drive roll dia. Dl in | 14.45 | 11.56 | 9.25 | 6.83 | 5.12 | 3.64 |
| Max HP/100FPM ($7.5\ Dl^2$) | 1566 | 1002 | 642 | 350 | 197 | 100 |
| Max RSF X 1000lb/in (using equn(viii) below | 47.1 | 37.7 | 28.5 | 21.2 | 15.3 | 11.3 |
| Max HP/100 FPM/in (using equn (vi)) | 20.2 | 16.2 | 12.2 | 9.1 | 6.6 | 4.9 |
| Max width at max. torque/in (HP/100FPM ÷ HP/100 FPM/in) | 78.75 | 63 | 51 | 37.5 | 27 | 21 |
| Min width (3 saddle pitches) | 33.75 | 27 | 25.5 | 18.75 | 13.5 | 10.5 |
| Min work roll dia. D2 in. | 4.70 | 3.76 | 3.01 | 2.22 | 1.66 | 1.18 |
| Value of K for maximum (X 1000lb/in$^2$) reduction (K = 14.14 X RS/D2) | 142 | 142 | 134 | 135 | 130 | 135 |
| Max work roll dia. D2 (60% of Dl)say) | 8.7 | 6.9 | 5.6 | 4.1 | 3.1 | 2.2 |
| Value of K for max. | | | | | | |

TABLE 3-continued

| | | | | | | |
|---|---|---|---|---|---|---|
| (X 1000 lb/in$^2$) reduction (at max D2) | 77 | 77 | 72 | 73 | 70 | 73 |

In the above table for the new mill, if D0 is the diameter of the main backing bearings 23 and 24 (FIG. 1), the horizontal distance between said bearings would normally be 1.1 D0. Furthermore, the load capacity of said bearings based upon direct loading is load capacity Co=1530×D0 lb/in width, and the load on each of said bearings is $$\frac{RSF}{2\sqrt{1-\left(\frac{1\cdot 1}{1+D1/D0}\right)^2}}.$$

Therefore the allowable RSF (which will just load said bearings to their full capacity) is given by the relationship $$RSF = 3060 \times D0 \times \sqrt{1-\left(\frac{1\cdot 1}{1+D1/D0}\right)^2} \quad \text{(viii)}$$

To establish the minimum work diameter which can be used with the roll configuration of subject invention it is necessary to be able to calculate the maximum diameter D3 of side intermediate rolls 28 and 29, and the maximum diameter of side backing rollers 21, 22, 25 and 26 that can be used with given central intermediate roll 27 and work roll 30. The load on said side backing rollers is next calculated (said load being proportional to the applied rolling torque) and compared with the capacity of side backing roller bearings, which is given by $$\text{load capacity } C_4 = 850 \times D4 \times (D4/D2)^{.3} \quad \text{(ix)}$$

(this formula, based upon published bearing ratings is used to provide a side backing roller bearing life equal to the life of work roll bearings in a four high mill). We have established that the maximum ratio of capacity to load for said side backing rollers is obtained if side intermediate rolls 28 and 29, and side backing rollers 21, 22, 25 and 26 are made as large as possible, even though the loads may not be shared equally between sets of side backing rollers.

The result of this is that the torque reaction force U2 which provides lateral support for the work roll does not, in general, act horizontally. (See FIGS. 14 and 15).

The calculation method is as follows:

To provide clearances for strip threading and strip sprays, clearances of K=0.14 R1, M=0.006 R1 and (I-R1)=0.06 R1 are provided (these clearances may be varied for different applications).

Side intermediate roll radius $$R3 = \frac{(J^2 - 2K(J - R2) - I^2)}{2(R1 + I)} \quad \text{(x)}$$

Co-ordinates of side intermediate roll center $$B = \sqrt{(R2+R3)^2 - (N-R2)^2} \quad \text{(xi)}$$

$$N = R3 + K \quad \text{(xii)}$$

To obtain side backing bearing radius (R4) and coordinates (X1, Y1) of the upper side backing bearing centers, (i.e. centers of 22 and 25, FIGS. 14) it is necessary to solve the following three simultaneous equations $$X1^2 + (Y1-J)^2 = (I+R4)^2 \quad \text{(viii)}$$

$$(X1-B)^2 + (Y1-N)^2 = (R3+R4)^2 \quad \text{(xiv)}$$

$$(X1-B-2\sqrt{R3R4})^2 + (Y1-R4-K)^2 = (2R4+M)^2 \quad \text{(xv)}$$

The co-ordinates (X2,Y2) of lower side backing bearing centers (i.e. centers of 21 and 26, FIG. 14) are then calculated $$X2 = B + 2\sqrt{R3R4} \quad \text{(xvi)}$$

$$Y2 = K + R4 \quad \text{(xvii)}$$

Figure 15:
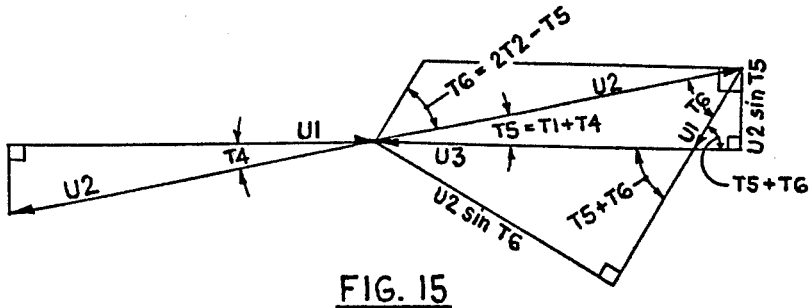
FIG. 15 is a force diagram corresponding to FIG. 14.

FIG. 15 shows the force diagrams for equilibrium of work roll 30 and side intermediate roll 29. The values of side support bearing loads U3 and U4 are determined as follows $$T4 = \text{arc tan}\left(\frac{N-R2}{B}\right) \quad \text{(xviii)}$$

From equn. (viii) allowable RSF is known
From (vi) V=RSF/2333 HP/100 FPM/in $$\text{Hence } U1 = \frac{V \times 33{,}000}{2 \times 100} = .0707\ RSF \quad \text{(xix)}$$

$$U2 = U1/\cos T4 \quad \text{(xx)}$$

$$T1 = \text{arc tan}\left(\frac{R3-R4}{2\sqrt{R3R4}}\right) \quad \text{(xxi)}$$

$$T2 = \text{arc sin}\left(\frac{R4+M/2}{R3+R4}\right) \quad \text{(xxii)}$$

$$T5 = T1 + T4 \quad \text{(xxiii)}$$

$$T6 = 2T2 - T5 \quad \text{(xxiv)}$$

$$U3 = \frac{U2 \sin T6}{\sin(T5+T6)} \quad \text{(xxv)}$$

$$U4 = \frac{U2 \sin T5}{\sin(T5+T6)} \quad \text{(xxvi)}$$

The procedure is iterative—first a value of R2 is selected, and the above procedure is used to establish values of R4, D4 (=2R4) U3 and U4, Hence C4 can be calculated (equn. (ix)). According to whether C4 is greater or less than U3 and U4 a smaller (or larger) R2 value (respectively) is selected and the procedure repeated until C4=U3 or U4, whichever is greater.

Figure 14:
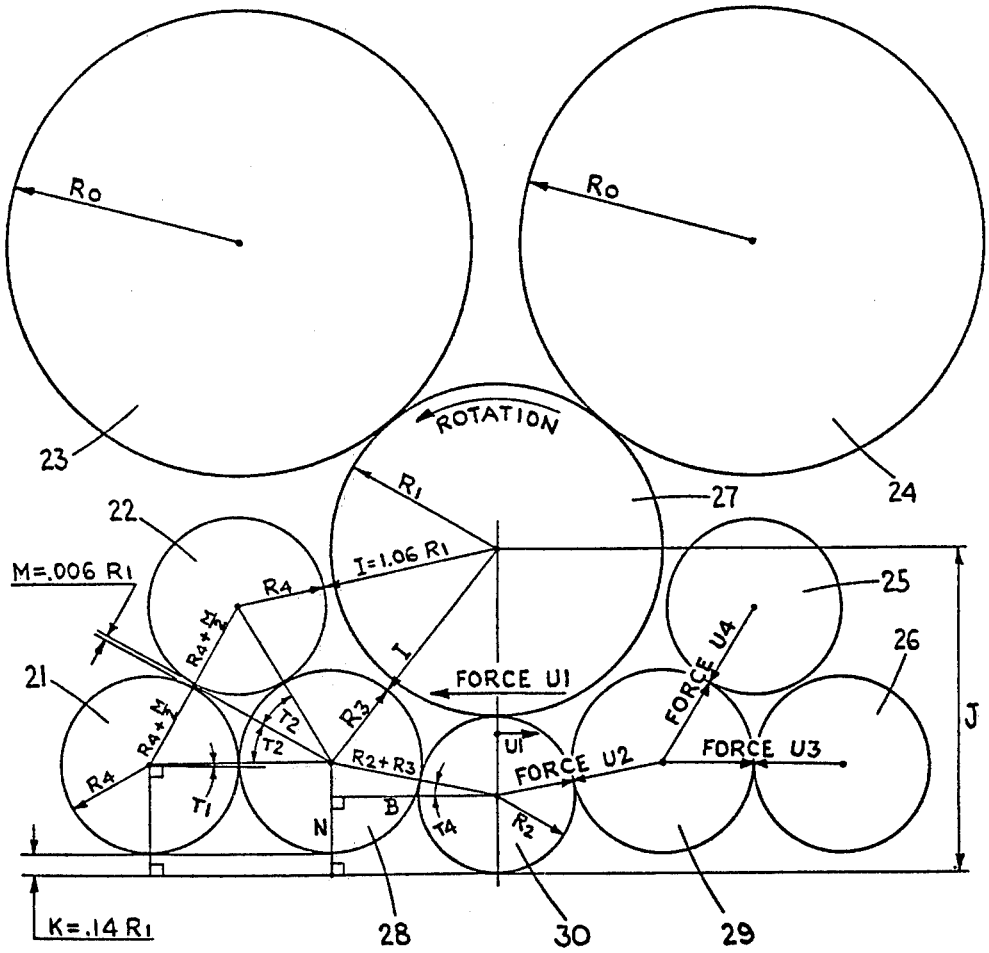
FIG. 14 is a diagrammatic front view of a cluster according to the present invention.

In practice, the minimum value of R2 which can be used, as determined by calculation or by layout, is about 25% of R1. The maximum value of R2 that can be used, if maximum R3 and R4 values are used as derived in the above calculation, is about 45% of R1. (limited by available space, as shown in FIG. 14). In this case, R3 and R4 approach their maximum values of about 125% of R2.

Actually, for the softer materials, for which the optimum value of R2 (relative to R1) becomes larger, the side support bearings are no longer critical, and the same size of side support assemblies and side intermediate rolls can be used if R2 is increased above 45% of R1. In this way it is possible to achieve values of R2 as high as 67% of R1 or even larger.

Furthermore, for a given upper backing bearing radius R0, it is always possible to use a larger drive roll, by selecting the standard drive roll from the next larger mill, and so on. In this way even larger work roll diameters could be used (without excessive size difference between work roll and drive roll)—there is no firm limit to the size of drive roll that can be adopted—cost is the only factor. It is also possible to use a slightly smaller drive roll than the one tabulated for each value of R0—the practical range of drive roll radius R0 being from approx. $\frac{5}{8}$ R1 to $1\frac{1}{4}$ R1.

Note that, since width is limited by permissible drive roll torque, then, if the drive roll diameter is increased the maximum width increases; and if the drive roll diameter is decreased the maximum width decreases.

It should be noted at this point that the preceding argument applies only to mills which are used for roughing for at least part of the time. Where high absolute reductions are not necessary, as on finishing trains, the same comparisons cannot be made. Furthermore, on stands operating at speeds over about 1500 FPM, and which are rolling large coils, (where yield losses due to off-gauge material during acceleration and deceleration of the mill are insignificant) the value of $\mu$ may drop to 0.035 or even less (depending on the lubricant) i.e. to around half of the previous value. This has the effect of doubling the optimum roll diameter (for a given material resistance to deformation) so that, under this condition, a four-high mill roll diameter may be optimum for material resistance to deformation values up to about 130,000 lb/in$^2$.

However, when rolling light gauges another factor comes into play. It is well known that a small work roll is capable of rolling material to lighter gauges than a large work roll. Stone's formula can be used to calculate achievable gauge; H2 (min)$=3.58\mu$ $D_2$ (K-S)/E where H2 (min)=minimum gauge that can be rolled (inch)

$\mu$=roll bite friction coefficient

D2=work roll diameter (inch)

K=resistance to deformation (hardness) of material to be rolled (lb/sq. in.)

S=average tension stress applied by coilers (lb/sq. in.)

E=elastic modulus of work rolls (lb/sq. in.)

Using this formula, and taking $\mu=0.07$ and S=0.2 K (i.e. maximum strip tension, during rolling, of 20% of the material hardness) and, considering rolling with steel rolls, for which $E=30X10^6$, we have $$h\text{min} = \frac{3.58 \times .07 \times 0.8 \times D^2 \times K}{30 \times 10^6} = \frac{KD^2}{150 \times 10^6}$$

and hmin can be tabulated for various values of $D_2$ and K

TABLE 4

| $K \times 10^3$ = | 400 | 300 | 200 | 150 | 100 |
|---|---|---|---|---|---|
| $D_2$ = 20 | .053 | .040 | .0267 | .020 | .0133 |
| 10 | .027 | .020 | .0133 | .010 | .0067 |
| 6 | .016 | .012 | .008 | .006 | .004 |
| 4 | .011 | .008 | .0053 | .004 | .0027 |
| 2 | .005 | .004 | .0027 | .002 | .0013 |

(Note that rather smaller hmin. values can be achieved when rolling speeds are very high, since under these conditions $\mu$ could be as small as half of the above value).

In practice, very large tonnages of materials having hardness in the range 100,000 to 300,000 lb/squ. in. are rolled, and it can be seen from Table 1 and Table 4 that the four-high mill is not capable of rolling light gauges (less than 0.01 in., say) except at very narrow widths and with soft materials. On the other hand, by comparison of Table 2 and Table 4, it can be seen that the 20-Hi cluster mill can roll virtually any hardness of material, up to very large widths, down to extremely light gauges.

By comparing Table 3 with Table 4, it can be seen that the mill of subject invention is capable of rolling even the hardest materials down to light gauges.

Thus, provided finishing gauges are not extremely light, the mill of subject invention can for materials of intermediate hardness, provide higher initial reductions than a 20-Hi cluster mill or a 4-high mill, and provide lighter finished gauges than the 4-high mill.

Several proposals have been made in the past for a rolling mill having a work roll size smaller than that of a four-high mill. Perhaps the best known is the so-called MKW mill (U.S. Pat. No. 4,059,002) which is basically a back-up roll driven four-high rolling mill having very small work rolls which are prevented from lateral flexure by offsetting them to one side of the mill centerline, and providing side support rollers on that side to support the work rolls in the horizontal plane against the horizontal component of the RSF.

This design has had a fair degree of success and a number of mills of this type are in operation. The mill of subject invention has advantages relative to the MKW mill in that, due to the large difference in diameter between work roll and back-up roll on the MKW mill, reductions are limited due to spalling of the back-up roll (roll contact stresses being a direct function of diameter ratio).

We claim:

1. A cluster rolling mill consisting of a pair of work rolls, each of said work rolls being supported by three intermediate rolls, each of said intermediate rolls being supported by two backing roller assemblies, said backing roller assemblies being suitably mounted in a stationary support structure, so that all rolls are fully supported along their length in vertical and horizontal planes.

2. A mill according to claim 1 in which said backing roller assemblies take the form of stationary shafts supported by fixed saddles at intervals along their length, rollers (casters) being mounted upon said shafts at intervals between said saddles, said rollers being in direct contact with, and directly supporting the intermediate rolls within the roll cluster.

3. A mill according to claim 1 in which at least one of the three pairs of backing assemblies are provided with means for adjusting the clearances between the work roll and the intermediate rolls.

4. A mill according to claim 1 in which said stationary support structure takes the form of a one piece housing, in combination with side support beams adjustably mounted within said housing.

5. A mill according to claim 1 in which said stationary support structure takes the form of a pair of conventional housings of the type used on four-high mills in combination with chock-like upper and lower support beams which mount within the windows of said housings, and in combination with side support beams adjustably mounted in spacers mounted between said housings.

6. A mill according to claim 1 whose proportions are determined as follows:

(a) of the three intermediate rolls in each cluster, the largest, which is the driven roll, is mounted centrally in the same vertical plane as the work roll axes, and said work roll has a diameter in the range $\frac{1}{4}$ to $\frac{2}{3}$ the diameter of said largest intermediate roll;

(b) said largest intermediate roll is supported by central backing roller assemblies, and has a diameter in the range $\frac{5}{8}$ to $1\frac{1}{4}$ times the diameter of said central backing roller assemblies;

(c) the two smaller intermediate rolls in each cluster are of equal size, and are mounted symmetrically about said vertical plane through the work roll axes, on either side of said work roll, supporting the work roll against lateral flexure;

(d) said smaller intermediate rolls have a diameter up to $1\frac{1}{4}$ times the diameter of said work roll;

(e) the two pairs of backing roller assemblies which support the smaller intermediate rolls (side backing roller assemblies) are of equal size, and are mounted symmetrically about said vertical plane through the work roll axes, on either side of said work roll, and have a diameter up to $1\frac{1}{4}$ times the diameter of the work roll.

* * * * *